US009846001B2

(12) United States Patent
Ask et al.

(10) Patent No.: US 9,846,001 B2
(45) Date of Patent: Dec. 19, 2017

(54) HEAT EXCHANGER ASSEMBLY AND USE OF AN APPARATUS IN A HEAT EXCHANGER

(75) Inventors: Torsten Ask, Lund (SE); Robert Broad, Malmö (SE)

(73) Assignee: ALFA LAVAL CORPORATE AB, Lund (SE)

( * ) Notice: Subject to any disclaimer, the term of this patent is extended or adjusted under 35 U.S.C. 154(b) by 594 days.

(21) Appl. No.: 13/978,756

(22) PCT Filed: Jan. 11, 2012

(86) PCT No.: PCT/EP2012/050364
§ 371 (c)(1),
(2), (4) Date: Jul. 9, 2013

(87) PCT Pub. No.: WO2012/104118
PCT Pub. Date: Aug. 9, 2012

(65) Prior Publication Data

US 2013/0284413 A1 Oct. 31, 2013

(30) Foreign Application Priority Data

Feb. 4, 2011 (EP) ..... 11153418

(51) Int. Cl.
*F28F 13/00* (2006.01)
*F28B 9/00* (2006.01)
(Continued)

(52) U.S. Cl.
CPC ..... *F28F 13/00* (2013.01); *F28B 9/00* (2013.01); *F28D 9/00* (2013.01); *F28F 27/00* (2013.01); *F28F 2265/12* (2013.01)

(58) Field of Classification Search
CPC .. F28F 27/02; F28F 9/026; F28F 9/001; F28F 9/0236; F28F 2265/12; F28F 27/00;
(Continued)

(56) References Cited

U.S. PATENT DOCUMENTS 1,690,501 A * 11/1928 Potts ..... 165/283
2,501,804 A * 3/1950 Yates et al. ..... 138/30
(Continued)

FOREIGN PATENT DOCUMENTS

CN 2240702 Y 11/1996
DE 1 927 234 12/1969
(Continued)

OTHER PUBLICATIONS

*International Search Report (PCT/ISA/210) dated May 22, 2012, by the European Patent Office as the International Searching Authority for International Application No. PCT/EP2012/050364.
(Continued)

*Primary Examiner* — Len Tran
*Assistant Examiner* — Gustavo Hincapie Serna
(74) *Attorney, Agent, or Firm* — Buchanan Ingersoll & Rooney PC

(57) ABSTRACT

A heat exchanger assembly comprises a heat exchanger for heat exchange between at least a first heat exchange fluid and a second heat exchange fluid. The heat exchanger comprises at least one heat transfer element delimiting a first fluid path from a second fluid path, and a through connection for the first heat exchange fluid arranged at a first side portion of an outer structure of the heat exchanger. The assembly comprises a pressure pulse damping apparatus comprising an elastic element, and a first conduit leading to the elastic element. The first conduit comprises a first opening connected to the through connection of the heat exchanger such that the first conduit is fluidly connected with the first fluid path. The elastic element fluidly communicates with the first fluid path only via the first opening. There is further disclosed use of a pressure pulse damping apparatus comprising an elastic element.

12 Claims, 5 Drawing Sheets

(51) Int. Cl.
*F28D 9/00* (2006.01)
*F28F 27/00* (2006.01)

(58) Field of Classification Search
CPC .. F17C 13/00; F01B 25/02; F28B 9/00; F28D 9/00
USPC ..... 165/281, 286, 96, 134.1, 69, 81, 167; 137/224.5
See application file for complete search history.

(56) References Cited

U.S. PATENT DOCUMENTS

| | | | | |
|---|---|---|---|---|
| 2,535,749 | A * | 12/1950 | Mueller | 417/46 |
| 3,047,274 | A * | 7/1962 | Wilson | 165/281 |
| 3,799,256 | A | 3/1974 | Gaines, Jr. | |
| 4,991,643 | A | 2/1991 | Price et al. | |
| 5,931,219 | A * | 8/1999 | Kull | F28D 9/005 165/166 |
| 6,148,631 | A * | 11/2000 | Watanabe | F25B 41/003 181/196 |
| 6,253,837 | B1 * | 7/2001 | Seiler et al. | 165/103 |
| 6,402,912 | B1 * | 6/2002 | Herrera | C23C 14/3407 204/298.12 |
| 6,604,364 | B1 * | 8/2003 | Arman | F01K 25/065 60/520 |
| 7,854,256 | B2 * | 12/2010 | Pineo et al. | 165/297 |
| 2005/0178536 | A1 * | 8/2005 | Blomgren | B21D 53/04 165/167 |
| 2005/0274329 | A1 * | 12/2005 | Brewster | F24D 1/005 122/36 |
| 2009/0166022 | A1 * | 7/2009 | Desai et al. | 165/279 |
| 2009/0269639 | A1 * | 10/2009 | Hobmeyr | F16K 17/04 429/513 |
| 2011/0067853 | A1 * | 3/2011 | Moser et al. | 165/297 |

FOREIGN PATENT DOCUMENTS

| | | | |
|---|---|---|---|
| DE | 10226204 | A1 | 12/2003 |
| DE | 10354047 | A1 | 6/2005 |
| DE | 102005002408 | B3 | 7/2006 |
| EP | 1577630 | A2 * | 9/2005 |
| GB | 178317 | A | 4/1922 |
| GB | 2104595 | A | 3/1983 |
| JP | 52-120445 | A | 10/1977 |
| JP | 55-14468 | A | 1/1980 |
| JP | 6-313566 | A | 11/1994 |
| WO | WO 2008/062409 | A2 | 5/2008 |
| WO | WO 2009/127899 | A2 | 10/2009 |

OTHER PUBLICATIONS

*Written Opinion (PCT/ISA/237) dated May 22, 2012, by the European Patent Office as the International Searching Authority for International Application No. PCT/EP2012/050364.

Communication pursuant to Article 94(3) EPC dated Feb. 17, 2014, by the European Patent Office, in corresponding European Patent Application No. 11 153 418.6 (4 pgs).

* cited by examiner

HEAT EXCHANGER ASSEMBLY AND USE OF AN APPARATUS IN A HEAT EXCHANGER

TECHNICAL FIELD

The present invention relates to a heat exchanger assembly according to the precharacterizing portion of claim 1, and to the use of a pressure pulse damping apparatus for damping pressure pulses in a heat exchanger

BACKGROUND

Heat exchangers for heat exchange between at least a first heat exchange fluid and a second heat exchange fluid are used in many different kinds of applications and processes, such as offshore oil platforms, steam condensate systems and fertilizer plants, to name a few. A heat exchanger may be used for many different purposes such as e.g. cooling and heating fluids, condensing gases, and evaporating liquids.

In some applications pressure pulses may occur in a heat exchange fluid. For instance, pressure pulses may occur in applications were one heat exchange fluid is a liquid in which slugs of gas may occur. For instance, on offshore oil platforms wet crude oil which contains oil, water, and fossil gas is extracted from a drill hole. The wet crude oil is heated in a heat exchanger for further processing. The fossil gas forms slugs in a conduit flowed through by the wet crude oil. A gas slug reaching the heat exchanger is followed by liquid (i.e. oil and water) which will enter the heat exchanger at high speed and cause a sharp pressure pulse which may damage the heat exchanger. Heat transfer elements may be damaged, gaskets may be blown. A different example of a heat exchange fluid containing gas is condensate or other liquid at a temperature close to the boiling point of the condensate/liquid. When such a condensate/liquid flows at high speed through a conduit, the pressure in the condensate/liquid may be reduced causing the condensate/liquid to boil and thus forming gas. A heat exchanger at an end of such a conduit will be subjected to pressure pulses for the same reason as explained above in connection with offshore oil drilling but also due to the gas expanding in the conduit pushing condensate/liquid ahead of the gas at high speed into the heat exchanger. Again, the heat exchanger may be damaged from such pressure pulses.

JP 55014468 suggests the use of a safety valve or a rupture disc connected to conduit at an inlet side of a condenser. When a pressure pulse occurs, the safety valve or the rupture disc opens a connection between the conduit at the inlet side of a condenser and a conduit at an outlet side of the condenser.

JP 52120445 suggests a bypass conduit between an inlet side and an outlet side of a condenser. In the bypass conduit a valve is arranged.

Although a condenser may be spared from a pressure pulses in the two above mentioned arrangements, the pressure pulse is not damped and equipment downstream of the condenser may be damaged by a pressure pulse.

JP 06-313566 discloses an air separator for water hammer prevention to be arranged in a domestic warm water system. The air separator comprises a main part forming a chamber with a water inlet leading to the chamber and an outlet leading from the chamber. Inside the chamber an air layer is formed and an air vent valve is arranged for venting air from the chamber. The air separator is arranged in an outlet conduit leading from a water heater to a radiator or water tap and thus relies on the water flowing through the chamber in order to absorb water hammering.

SUMMARY

An object of the present invention is to reduce or eliminate pressure pulses reaching a heat exchanger.

According to an aspect of the invention, the object is achieved by a heat exchanger assembly comprising a heat exchanger for heat exchange between at least a first heat exchange fluid and a second heat exchange fluid. The heat exchanger comprises at least one heat transfer element delimiting a first fluid path for the first heat exchange fluid from a second fluid path for the second heat exchange fluid inside the heat exchanger. The heat exchanger further comprises a through connection for the first heat exchange fluid arranged at a first side portion of an outer structure of the heat exchanger. The assembly comprises a pressure pulse damping apparatus, the apparatus comprising an elastic element, and a first conduit leading to the elastic element. The first conduit comprises a first opening connected to the through connection of the heat exchanger such that the first conduit is in fluid connection with the first fluid path. The elastic element is in fluid communication with the first fluid path only via the first opening.

Since the pressure pulse damping apparatus is connected to the heat exchanger such that the first conduit forms a dead-end at the elastic element, in use a pressure pulse in the first heat exchange fluid will cause the elastic element to be compressed and thus the pressure pulse to be damped. As a result, the above mentioned object is achieved and accordingly, the life time of the heat exchanger may be increased, and/or downtime and operational costs of the heat exchanger may be reduced.

In the heat exchanger the first and second heat exchange fluids are in heat exchanging communication with each other via the at least one heat transfer element. The pressure pulse damping apparatus has no further connection through which the first heat exchange fluid may enter and exit the pressure pulse damping apparatus than the first opening. The pressure pulse damping apparatus need not necessary eliminate a pressure pulse. More importantly, the pressure pulse damping apparatus reduces the amplitude of the pressure pulse such that instead of a short pressure impulse, a pressure pulse of lower amplitude will affect the heat exchanger over longer time. Such a pressure pulse may be more easily withstood by the heat exchanger. The heat exchanger and the pressure pulse damping apparatus may be offered separately.

According to embodiments the first conduit of the pressure pulse damping apparatus may be connected to the through connection at the first side portion opposite to a second side portion comprising an inlet for the first heat exchange fluid to the heat exchanger. In this manner the pressure pulse damping apparatus may be arranged in suitable position to damp a pressure pulse entering the heat exchanger, or forming inside the heat exchanger and/or the pressure pulse damping apparatus. The pressure pulse damping apparatus thus, may be arranged in a suitable position on the heat exchanger for damping the pressure pulse since the first point of impact for the pressure pulse may be at a side portion opposite to the inlet for the first heat exchange fluid.

According to embodiments the heat exchanger may comprise a straight fluid path from the inlet for the first heat exchange fluid to the through connection. In this manner a pressure pulse in the first heat exchange fluid will substantially unimpededly reach the pressure pulse damping apparatus and the point of impact of the pressure pulse may primarily be in the pressure pulse damping apparatus.

According to embodiments the elastic element may comprises a movable partition, the movable partition being adapted in use to be subjected to a pressure pulse in the first heat exchange fluid. In this manner the movable partition may delimit the first heat exchange fluid from other parts of the elastic element.

According to embodiments the elastic element may comprise a chamber which is at least partially filled with a gas, the chamber and the first conduit forming a closed compartment. Since the gas is enclosed in a chamber and is a compressible medium, the gas may damp a pressure pulse in the first heat exchange fluid. It is to be understood that the closed compartment is closed in all directions except for at the first opening.

According to embodiments the chamber may be elongated and arranged substantially perpendicularly to the first conduit. In this manner the pressure pulse damping apparatus may be formed to extend alongside the first side portion of the heat exchanger. In many applications this may be an advantageous arrangement of the pressure pulse damping apparatus, e.g. due to limited available space around the heat exchanger.

According to embodiments the gas inside the chamber may be delimited by the movable partition such that in use the pressure pulse in the first heat exchange fluid is transferred via the movable partition to the gas inside the chamber.

According to embodiments the movable partition may comprise a membrane or a piston. A membrane may for instance partially or fully enclose a gas in a chamber of the pressure pulse damping apparatus. A piston may abut an inner wall of the pressure pulse damping apparatus such as inner walls of a chamber.

According to embodiments the elastic element may comprise a spring, the spring abutting the movable partition. The spring may thus be affected and compressed by a pressure pulse in the first heat exchange fluid and damp the pressure pulse.

According to embodiments the heat exchanger may be a plate heat exchanger and the heat transfer element may be formed by a heat transfer plate. A plate heat exchanger may typically have a number of heat transfer plates arranged in a plate package. The heat transfer plates are each provided with for instance four port holes, forming four channels through the plate package. Inlet and outlet conduits for two heat exchange fluids are arranged in fluid communication with four channels.

According to embodiments the first side portion of the heat exchanger may be formed by a pressure plate or a frame plate. The second side portion may accordingly be formed by the other of the pressure plate and the frame plate. A plate package of a plate heat exchanger may typically be clamped between the frame plate, which is fixed to a frame, and the pressure plate, which in some types of plate heat exchangers may be movable. The inlet and outlet conduits may be connected to the frame plate.

According to embodiments the pressure pulse damping apparatus may comprise a flange arranged circumferentially around the first conduit at the first opening for connecting the pressure pulse damping apparatus to the heat exchanger. The flange may be provided with through holes such that it may be attached to the heat exchanger by means of screws, or nuts and bolts.

A further aspect of the invention relates to use of a pressure pulse damping apparatus comprising an elastic element and a first conduit leading to the elastic element for damping pressure pulses in a heat exchanger. The first conduit comprises a first opening adapted to be connected the heat exchanger such that the first conduit is in fluid connection with a first fluid path of the heat exchanger. The elastic element is in fluid communication with the first fluid path only via the first opening.

The use of such a pressure pulse damping apparatus will absorb or at least reduce pressure pulses in a first heat exchange fluid in a relevant heat exchanger. Again, since the pressure pulse damping apparatus forms a dead-end at the elastic element, a pressure pulse in the first heat exchange liquid in the first fluid path will cause the elastic element to be compressed and thus the pressure pulse to be damped. As a result, the above mentioned object is achieved.

The pressure pulse damping apparatus has no further connection through which the first heat exchange fluid may enter and exit the pressure pulse damping apparatus than the first opening. Again, the pressure pulse damping apparatus need not necessary eliminate a pressure pulse. More importantly, the pressure pulse damping apparatus reduces the amplitude of the pressure pulse such that instead of a short pressure impulse, a pressure pulse of lower amplitude will affect a relevant heat exchanger over longer time. Such a pressure pulse may be more easily withstood by the heat exchanger.

According to embodiments, use of the pressure pulse damping apparatus may comprise the first conduit of the pressure pulse damping apparatus to be connected to the through connection at the first side portion opposite to a second side portion comprising an inlet for the first heat exchange fluid to the heat exchanger.

According to embodiments, use of the pressure pulse damping apparatus may comprise the heat exchanger comprising a straight fluid path from the inlet for the first heat exchange fluid to the through connection.

According to embodiments, the use of the pressure pulse damping apparatus may comprise the elastic element comprising a movable partition, the movable partition being adapted in use to be subjected to a pressure pulse in the first heat exchange fluid.

According to embodiments the use of the pressure pulse damping apparatus may comprise the elastic element comprising a chamber which may be at least partially filled with a gas, the chamber and the first conduit forming a closed compartment.

According to embodiments the use of the pressure pulse damping apparatus may comprise the chamber being elongated and arranged substantially perpendicularly to the first conduit.

According to embodiments the use of the pressure pulse damping apparatus may comprise the gas inside the chamber being delimited by the movable partition such that in use the pressure pulse in the first heat exchange fluid may be transferred via the movable partition to the gas inside the chamber.

According to embodiments the use of the pressure pulse damping apparatus may comprise the movable partition comprising a membrane or a piston.

According to embodiments the use of the pressure pulse damping apparatus may comprise the elastic element comprising a spring, the spring abutting the movable partition.

According to embodiments the use of the pressure pulse damping apparatus may comprise the heat exchanger being a plate heat exchanger and the heat transfer element being formed by a heat transfer plate.

According to embodiments the use of the pressure pulse damping apparatus may comprise the first side portion of the heat exchanger being formed by a pressure plate or a frame plate and the second side portion being formed by the other of the pressure plate and the frame plate.

Further features of, and advantages with, the present invention will become apparent when studying the appended claims and the following detailed description. Those skilled in the art will realize that different features of the present invention may be combined to create embodiments other than those described in the following, without departing from the scope of the present invention, as defined by the appended claims.

BRIEF DESCRIPTION OF THE DRAWINGS

The various aspects of the invention, including its particular features and advantages, will be readily understood from the following detailed description and the accompanying drawings, in which:

FIGS. 1-5 also illustrate embodiments of use of pressure pulse damping apparatuses for damping pressure pulses in heat exchangers.

DETAILED DESCRIPTION

The present invention will now be described more fully with reference to the accompanying drawings, in which example embodiments are shown. However, this invention should not be construed as limited to the embodiments set forth herein. Disclosed features of example embodiments may be combined as readily understood by one of ordinary skill in the art to which this invention belongs. Like numbers refer to like elements throughout.

Well-known functions or constructions will not necessarily be described in detail for brevity and/or clarity.

Figure 1:
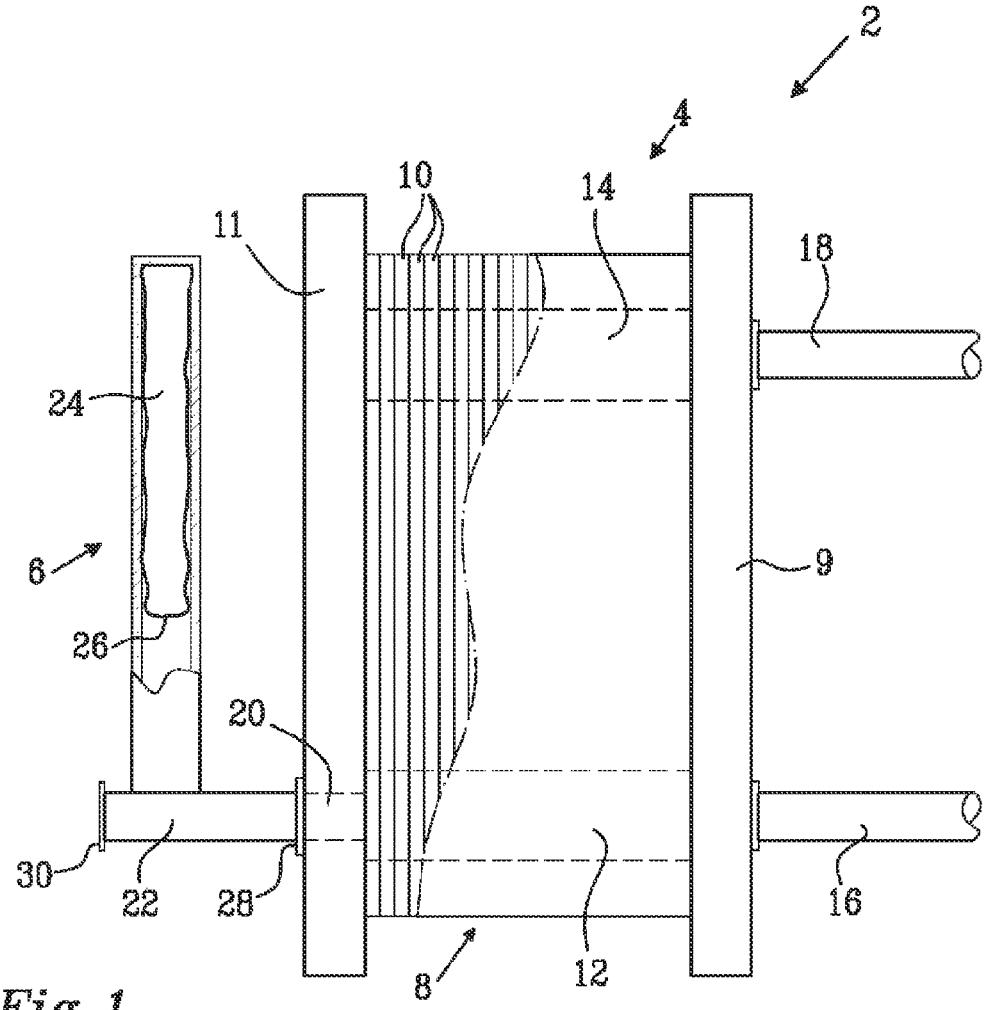
FIGS. 1-5 illustrate heat exchanger assemblies according to embodiments comprising a heat exchanger and a pressure pulse damping apparatus.

FIG. 1 illustrates a heat exchanger assembly 2 according to embodiments comprising a heat exchanger 4 and a pressure pulse damping apparatus 6. FIG. 1 also illustrates embodiments of use of a pressure pulse damping apparatus 6 for damping pressure pulses in the heat exchanger 4. The pressure pulse damping apparatus 6 is shown partially in cross section. As well known in the technical field of heat exchangers, the plate heat exchanger 4 is provided with a plate package 8 of heat exchange plates 10 clamped between a frame plate 9 and a pressure plate 11. The pressure plate 11 may be seen as a first side portion of the heat exchanger 4 and the frame plate 9 may be seen as a second side portion of the heat exchanger 4. The heat exchange plates 10 are utilized for exchange of heat between a first and a second heat exchange fluid. The plates 10 form plate interspaces adapted to be flowed through by the heat exchange fluids. The plates 10 are provided with four port holes which form inlet and outlet channels 12, 14 (two of which are indicated by broken lines in FIG. 1) extending through the plate package 8 and communicating with the plate interspaces. In use, a first heat exchange fluid flows through an inlet conduit 16 into the inlet channel 12, through every second plate interspace of the plate package 8 to the outlet channel 14, and out of the heat exchanger 4 to an outlet conduit 18.

The pressure plate 11 forms the first side portion of the plate heat exchanger 4 and is provided with a through connection 20 forming an extension of the inlet channel 12. The pressure pulse damping apparatus 6 is connected to the pressure plate 11 such that a first conduit 22 of the pressure pulse damping apparatus 6 is in fluid communication with the inlet channel 12 via the through connection 20. Accordingly, in use the first conduit 22 is filled with the first heat exchange fluid. The pressure pulse damping apparatus 4 comprises a chamber 24 which is filled with a gas such as air. The chamber 24 is closed and a movable partition in the form of a membrane 26 at least partially encloses the gas, and delimits the gas from the first heat exchange fluid. The membrane 26 and the gas in the chamber 24 form an elastic element.

Frame plates 9 and pressure plates 11 are frequently manufactured with through holes in positions where the inlet and outlet channels in the plate package 8 are arranged. Through holes which are not required in use are closed by covers. Thus, the through connection 20 may be readily available for forming a fluid connection between the first conduit 22 and the inlet channel 12. Inlet and outlet channels 12, 14 for the heat exchange fluids communicate with the inlet and outlet conduits 16, 18 via to the through holes in the frame plate 9.

When in use of a heat exchanger 4 with a first heat exchange fluid, primarily being in liquid form, a pressure pulse arrives with the first heat exchange fluid to the heat exchanger 4, the pressure pulse will travel along the inlet channel 12 into the first conduit 22 of the pressure pulse damping apparatus 6. When the pressure pulse arrives at the membrane 26 the gas on the other side of the membrane 26 is compressed by the pressure pulse. Similarly, when a gas slug enters the inlet channel 12 and is followed by liquid at high speed, a pressure pulse is formed when the liquid impacts against the membrane 26.

The pressure pulse will be transmitted to the gas in the chamber 26 and since the gas is compressible, the pressure pulse will be damped. Furthermore, the speed of the pressure pulse will decrease as it gradually compresses the gas. Accordingly, if the pressure pulse is not absorbed by the gas the pressure pulse transmitted from the gas back to the first heat exchange fluid will have lower amplitude and be distributed over a longer time than the original pressure pulse. The pressure pulse affecting the heat exchanger 4 will thus be of a kind which is more easily withstood by the heat exchanger 4 and its plate package 8, seen in contrast with a pressure pulse impacting, or forming, on an inside of the pressure plate 11 and being transmitted through the plate package 8 towards the outlet conduit 18.

The first conduit 22 comprises a first opening connected to the through connection 20. A flange 28 is arranged circumferentially around the first conduit 22 at the first opening for connecting the pressure pulse damping apparatus 6 to the pressure plate 11. The flange 28 may be provided with through holes such that it may be attached to the heat exchanger 4 by means of screws, or nuts and bolts. Thus, the pressure pulse damping apparatus 6 may easily be attached retroactively in an already present installation if it is revealed that the installation is troubled by pressure pulses. Such retroactive installation may also be performed in a flammable environment since no welding is necessary. The pressure pulse damping apparatus 6 may comprise a lid 30, through which the first conduit 22 of the pressure pulse damping apparatus 6 and the inlet channel 12 of the plate heat exchanger 4 are accessible. A filter (also called port strainer) may be positioned in the inlet channel 12 via the lid 30. When the heat exchanger 4 is in use, the lid 30 is maintained closed.

Figure 2:
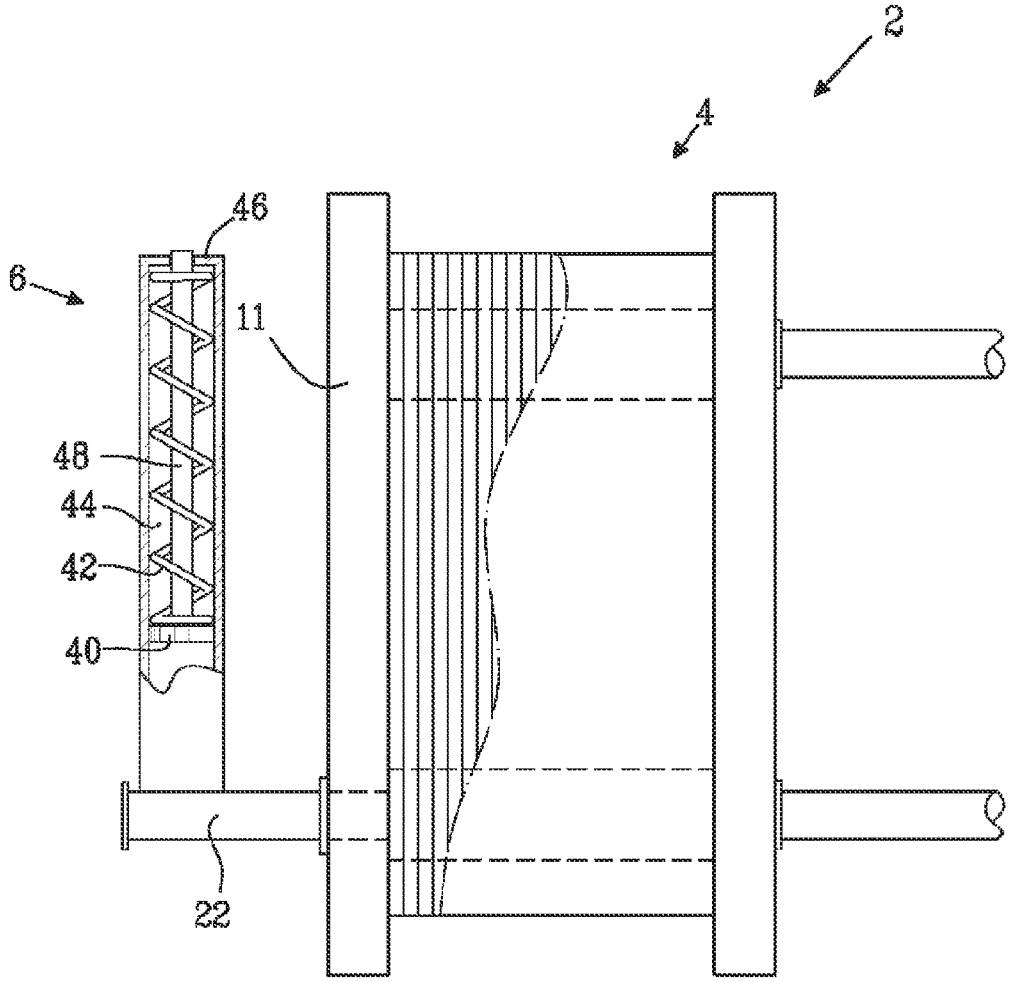

FIG. 2 illustrates a heat exchanger assembly 2 according to embodiments comprising a heat exchanger 4 and a pressure pulse damping apparatus 6. FIG. 2 also illustrates embodiments of use of a pressure pulse damping apparatus 6 for damping pressure pulses in the heat exchanger 4. The pressure pulse damping apparatus 6 is shown partially in cross section. The pressure pulse damping apparatus 6 comprises a first conduit 22 connected to a pressure plate 11 of the heat exchanger 4, and an elastic element comprising a piston 40 and a spring 42. Again, the first conduit 22 communicates with an inlet channel for a first heat exchange fluid in the heat exchanger 4. The piston 40 is a movable partition, in use delimiting inter alia a chamber 44 and the spring 42 from the first heat exchange fluid in the first conduit 22. The piston 40 is movable along inner walls of the chamber 44, which has a uniform inner diameter. The spring 42 is arranged in the chamber 44 and abuts against the piston 40 and an end wall 46 of the chamber 44. The end wall 46 is provided with a through hole for a rod 48 attached to the piston 40 to pass through. When a pressure pulse in the first heat exchange fluid via the first conduit 22 impacts against the piston 40, the spring 42 is compressed and the piston 40 is moved into the chamber 44. Thus, the pressure pulse is damped and at least partially absorbed.

A further damping effect may be achieved by air inside the chamber 44, which is forced through the through hole in the end wall 46 as the piston is moved into the chamber 44. As the spring 42 again expands, the movement of the piston 40 is damped by air being admitted into the chamber 44 only at a limited rate through the through hole in the end wall 46. In this manner the pressure pulse may be further damped since any pressure pulse being reflected back into the first heat exchange fluid by the spring 42 and the piston 40 is restricted.

Figure 3:
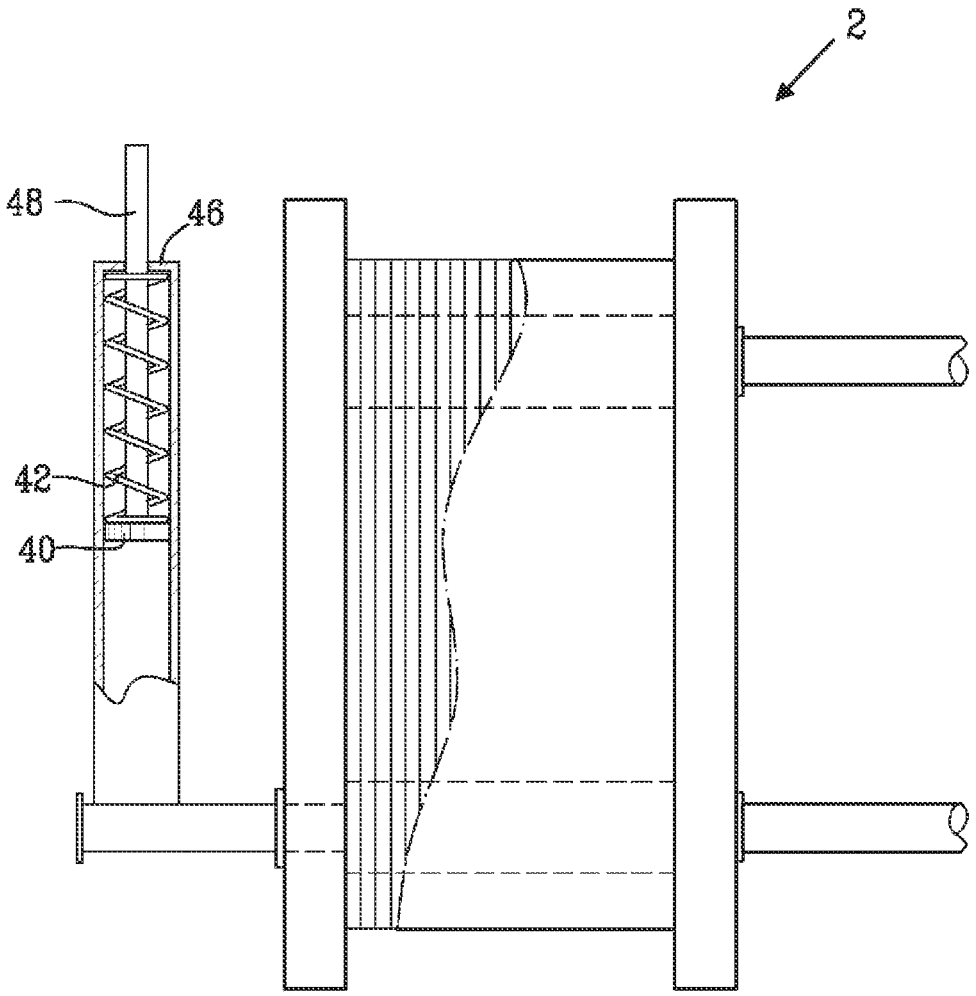

FIG. 3 illustrates the assembly 2 of FIG. 2 when the piston 40 and the spring 42 has been affected by a pressure pulse in the first heat exchange fluid. The spring 42 has thus, been compressed. The rod 48 extends through the through hole in the end wall 46 of the chamber 44.

Figure 4:
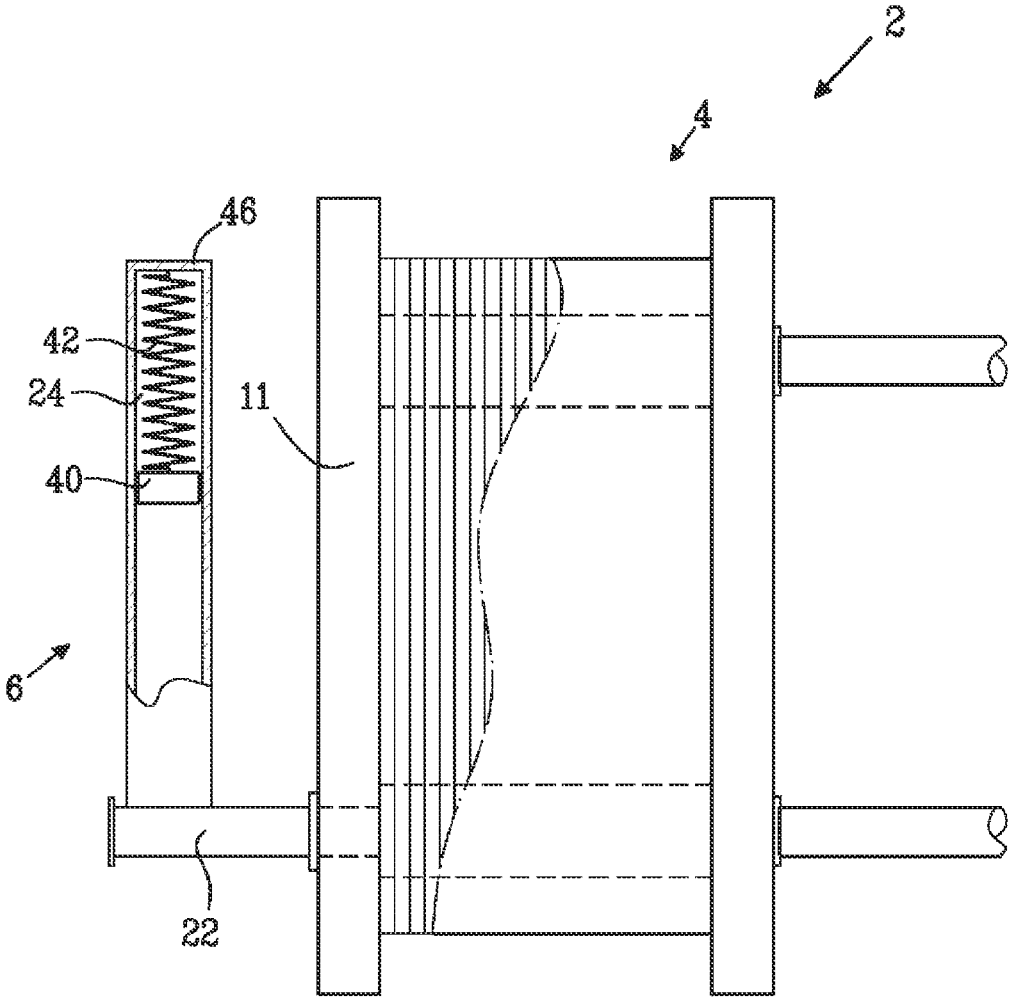

FIG. 4 illustrates a heat exchanger assembly 2 according to embodiments comprising a heat exchanger 4 and a pressure pulse damping apparatus 6. FIG. 4 also illustrates embodiments of use of a pressure pulse damping apparatus 6 for damping pressure pulses in the heat exchanger 4. The pressure pulse damping apparatus 6 is shown partially in cross section. The pressure pulse damping apparatus 6 comprises a first conduit 22 connected to a pressure plate 11 of the heat exchanger 4. Again, the first conduit 22 communicates with an inlet channel for a first heat exchange fluid in the heat exchanger 4. The pressure pulse damping apparatus 6 further comprises an elastic element comprising a piston 40, a spring 42, and a chamber 24. The piston 40 is a movable partition, in use delimiting inter alia the chamber 24 and the spring 42 from the first heat exchange fluid in the first conduit 22. The piston 40 is movable along inner walls of the chamber 24, which has a uniform inner diameter. The spring 42 is arranged in the chamber 24 and abuts against the piston 40 and an end wall 46 of the chamber 24. The chamber 24 is filled with a gas such as air and closed by means of the piston 40, which delimits the gas from the first heat exchange fluid. The piston 40, the spring 42, and the gas in the chamber 24 form an elastic element.

In the embodiments according to FIG. 4, the spring 42 and the gas enclosed in the chamber 24 cooperate to damp pressure pulses in the first heat exchange fluid.

Figure 5:
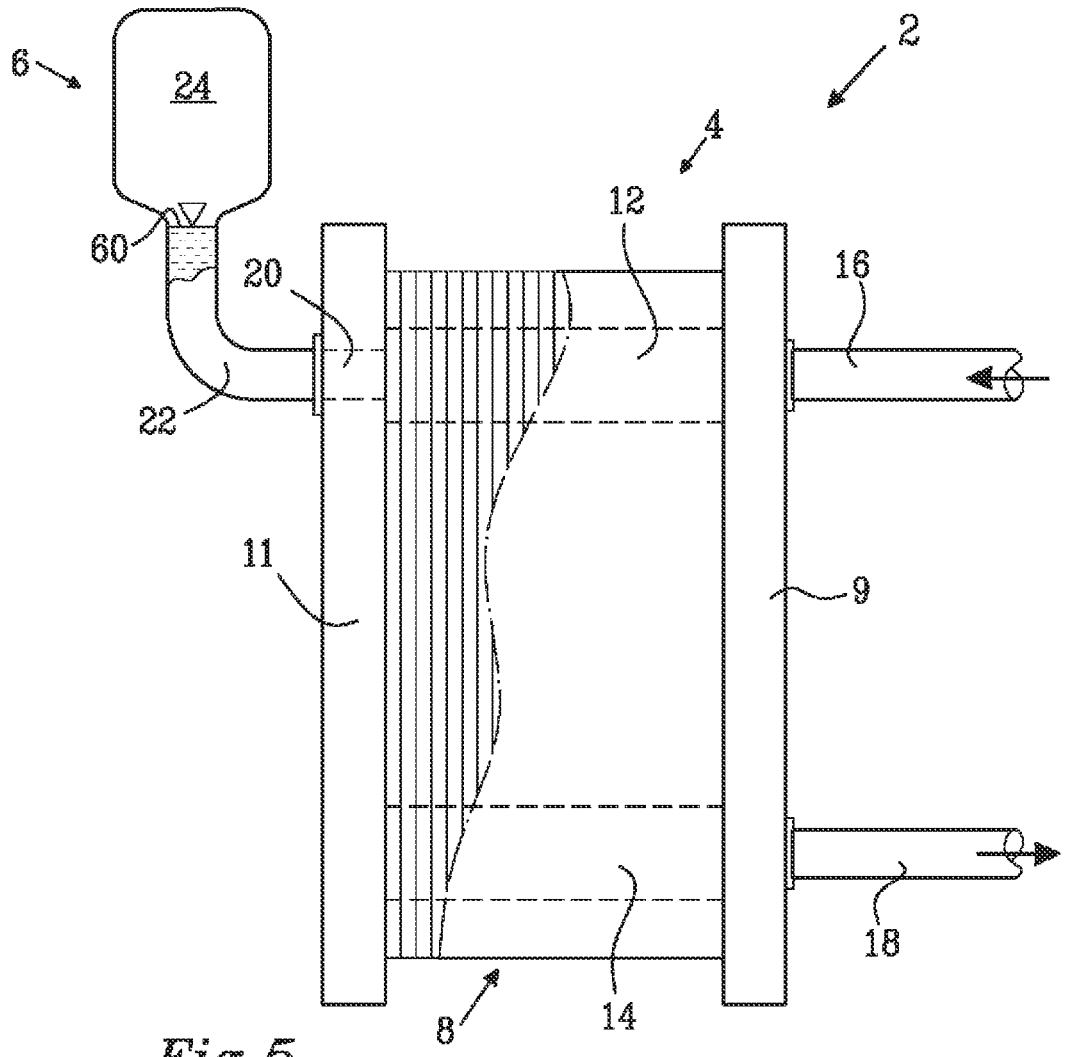

FIG. 5 illustrates a heat exchanger assembly 2 according to embodiments comprising a heat exchanger 4 and a pressure pulse damping apparatus 6. FIG. 5 also illustrates embodiments of use of a pressure pulse damping apparatus 6 for damping pressure pulses in the heat exchanger 4. The pressure pulse damping apparatus 6 is shown partially in cross section. The pressure pulse damping apparatus 6 comprises a first conduit 22 connected to a pressure plate 11 of the heat exchanger 4. Again, the first conduit 22 communicates with an inlet channel 12 for a first heat exchange fluid in the heat exchanger 4. However, in these embodiments the inlet channel 12 is arranged at an upper end of the plate package 8. Accordingly, the inlet conduit 16 is connected to the frame plate 9 at an upper end thereof, and an outlet channel 14 with a matching outlet conduit 18 are arranged at a lower end of the plate package 8 and the frame plate 9.

The pressure pulse damping apparatus 6 further comprises a chamber 24, which communicates with the first conduit 22. In use the chamber 24 is filled with a gas, such as air, and the first heat exchange fluid substantially fills the first conduit 22. The first heat exchange fluid, primary comprising a liquid, forms a liquid surface 60 in the first conduit 22 or the chamber 24. Under stable operating conditions the liquid surface 60 will remain at substantially the same level. When a pressure pulse in the first heat exchange fluid enters the inlet channel 12, the pressure pulse is transferred through the first conduit 22 to the gas filled chamber 24. The gas inside the chamber 24 forms an elastic element. Since the gas is compressible the gas will be compressed by the pressure pulse and thus damp the pressure pulse as explained above. As the pressure pulse compresses the gas in the chamber 24 the liquid level 60 is temporarily raised.

Figure 6:
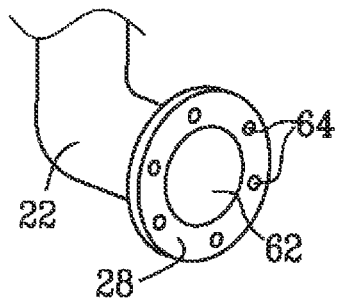
FIG. 6 illustrates a portion of a pressure pulse damping apparatus according to example embodiments.

FIG. 6 illustrates a portion of a pressure pulse damping apparatus 6 according to example embodiments. A first conduit 22 leads to a non-shown elastic element. A first opening 62 is adapted to be connected to a through connection of a heat exchanger such that the first conduit 22 is in fluid connection with a first fluid path of a heat exchanger. The elastic element is in fluid communication with the first fluid path only via the first opening 62. A flange 28 is arranged circumferentially around the first conduit 22 at the first opening 62. The flange 28 is provided with through holes 64.

Purely as an example it may be mentioned that a pressure pulse damping apparatus according to embodiments for damping pressure pulses in a heat exchanger used in offshore wet crude oil heating may have the following dimensions. The first conduit of the pressure pulse damping apparatus leads to a cylinder filled with gas thus, forming the gas filled chamber 24. The cylinder has a diameter of 1 meter and an approximate height of 4.6 meters thus, housing a volume of approximately 3600 liters of gas. Inlet and outlet conduits for the wet crude oil of the heat exchanger have typically a diameter in the range of 250-500 mm. A pressure pulse damping apparatus of such dimensions is deemed to cope with pressure pulses commonly occurring in typical offshore wet crude oil handling.

A further example relates to steam condensate cooling. For instance, where in a conduit condensate at a temperature close to the boiling point of the condensate is subjected to a slightly varying pressure, so-called flash vapour may form. As the vapour expands. it will form a vapour pocket that accelerates and pushes a column of condensate at a high velocity through the conduit. As the condensate column has high kinetic energy, it may cause a pressure pulse when it is brought to a sudden stop at an end of the conduit, e.g. in a plate heat exchanger connected to the conduit and forming a condensate cooler. Such a pressure pulse may damage the plate heat exchanger. Again, a pressure pulse damping apparatus may be utilized for damping such a pressure pulse. The following dimensions are presented purely as an example: A condensate conduit leading to a plate heat exchanger for cooling condensate at a flow of about 66.000 kg/h may have a diameter of approximately 150-200 mm. The plate heat exchanger may have an internal volume of approximately 100 liters A gas volume of a gas filled chamber 24 of a pressure pulse damping apparatus 6 may be about 100 liters, e.g. in the form of a cylinder having a diameter of 300 mm and an approximate length of 1.5 m.

Example embodiments described above may be combined as understood by a person skilled in the art. It is also understood by those skilled in the art that heat exchangers benefiting from a pressure pulse damping apparatus may be of many kinds, for example plate heat exchangers provided with gaskets, welded plate heat exchangers, semi-welded plate heat exchangers, and fusion bonded plate heat exchangers.

Although the invention has been described with reference to example embodiments, many different alterations, modifications and the like will become apparent for those skilled in the art. The elastic element may comprise other pressure pulse damping elements than the exemplified gas filled chamber and spring, e.g. may the elastic element comprise an elastomer. The pressure pulse damping apparatus may have other shapes than disclosed. The pressure pulse damping apparatus may be directed in a different direction than disclosed, e.g. horizontally.

Therefore, it is to be understood that the foregoing is illustrative of various example embodiments and the invention is not to be limited to the specific embodiments disclosed and that modifications to the disclosed embodiments, combinations of features of disclosed embodiments as well as other embodiments are intended to be included within the scope of the appended claims.

As used herein, the term "comprising" or "comprises" is open-ended, and includes one or more stated features, elements, steps, components or functions but does not preclude the presence or addition of one or more other features, elements, steps, components, functions or groups thereof.

As used herein, the term "and/or" includes any and all combinations of one or more of the associated listed items.

As used herein, the common abbreviation "e.g.", which derives from the Latin phrase "exempli gratia," may be used to introduce or specify a general example or examples of a previously mentioned item, and is not intended to be limiting of such item. If used herein, the common abbreviation "i.e.", which derives from the Latin phrase "id est," may be used to specify a particular item from a more general recitation.

The terminology used herein is for the purpose of describing particular embodiments only and is not intended to be limiting of the invention. As used herein, the singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It will be understood that when an element is referred to as being "on", "coupled" or "connected" to another element, it can be directly on, coupled or connected to the other element or intervening elements may also be present. In contrast, when an element is referred to as being "directly on", "directly coupled" or "directly connected" to another element, there are no intervening elements present.

It will be understood that although the terms first, second, third etc. may be used herein to describe various elements, components, regions, layers and/or sections, these elements, components, regions, layers and/or sections should not be limited by these terms. These terms are only used top distinguish one element, component, region, layer or section from another element, component, region, layer or section. Thus, a first element, component, region, layer or section discussed herein could be termed a second element, component, region, layer or section without departing from the teachings of the present invention.

Spatially relative terms, such as "beneath", "below", "bottom", "lower", "above", "top", "upper" and the like, may be used herein for ease of description to describe one element's or feature's relationship to other element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly. Also, as used herein, "lateral" refers to a direction that is substantially orthogonal to a vertical direction.

Example embodiments of the present invention have been described herein with reference to cross-section illustrations that are schematic illustrations of idealized embodiments (and intermediate structures) of the invention. As such, variations from the shapes of the illustrations as a result, for example, of manufacturing techniques and/or tolerances are to be expected. Thus, embodiments of the present invention should not be construed as limited to the particular shapes of regions illustrated herein but are to include deviations in shape that result, for example, from manufacturing.

The invention claimed is:

1. A heat exchanger assembly comprising:

a plate heat exchanger for heat exchange between at least a first heat exchange fluid and a second heat exchange fluid, the plate heat exchanger comprising a plurality of heat transfer plates arranged between an inside of a pressure plate and an inside of a frame plate and delimiting a first fluid path for the first heat exchange fluid from a second fluid path for the second heat exchange fluid inside the plate heat exchanger, the first fluid path being defined between some pairs of adjacent ones of the heat transfer plates, the second fluid path being defined between other pairs of adjacent ones of the heat transfer plates, the plate heat exchanger also comprising a through connection in one of the frame plate and the pressure plate for the first heat exchange fluid, which through connection extends from the inside to an outside of said one of the frame plate and the pressure plate;

a pressure pulse damping apparatus comprising an elastic element, and a first conduit leading to the elastic element;

the first conduit comprising a first opening connected to the through connection of the plate heat exchanger such that the first conduit is in fluid connection with the first fluid path;

the elastic element being in fluid communication with the first fluid path only via the first opening;

the other one of the frame plate and the pressure plate comprising an inlet for the first heat exchange fluid to the plate heat exchanger;

a portion of the first fluid path being a straight fluid path extending from the inlet for the first heat exchange fluid, through the heat transfer plates, and to the through connection; and the pressure pulse damping apparatus being arranged after the straight fluid path in a flow direction wherein the first heat exchange fluid must flow along the straight fluid path and through said one of the frame plate and the pressure plate via the through connection to reach the pressure pulse damping apparatus.

2. The assembly according to claim 1, wherein the elastic element comprises a movable partition, the movable partition being adapted in use to be subjected to a pressure pulse in the first heat exchange fluid.

3. The assembly according to claim 1, wherein the elastic element comprises a chamber which is at least partially filled with a gas, the chamber and the first conduit forming a closed compartment.

4. The assembly according to claim 3, wherein the gas inside the chamber is delimited by the movable partition such that in use the pressure pulse in the first heat exchange fluid is transferred via the movable partition to the gas inside the chamber.

5. The assembly according to claim 2, wherein the movable partition comprises a membrane or a piston.

6. The assembly according to claim 2, wherein the elastic element comprises a spring, the spring abutting the movable partition.

7. Use of a pressure pulse damping apparatus comprising connecting the pressure pulse damping apparatus, which comprises an elastic element and a first conduit leading to the elastic element, to a heat exchanger for damping pressure pulses in the heat exchanger, the heat exchanger comprising a plurality of heat transfer plates arranged between an inside of a pressure plate and an inside of a frame plate and delimiting a first fluid path for a first heat exchange fluid from a second fluid path for a second heat exchange fluid inside the heat exchanger, wherein the first conduit comprises a first opening connected to the heat exchanger such that the first conduit is in fluid connection with the first fluid path of the heat exchanger, the heat exchanger also comprising a through connection in one of the frame plate and the pressure plate for the first heat exchange fluid, which through connection extends from the inside to an outside of said one of the frame plate and the pressure plate, the other one of the frame plate and the pressure plate comprising an inlet for the first heat exchange fluid to the heat exchanger, a portion of the first fluid path being a straight fluid path extending from the inlet to the through connection so that the first heat exchange fluid flows along the straight fluid path from the inlet to the through connection during operation of the heat exchanger, the pressure pulse damping apparatus being connected to the heat exchanger such that the elastic element is in fluid communication with the first fluid path only via the first opening, and the pressure pulse damping apparatus being arranged after the straight fluid path in a flow direction wherein the first heat exchange fluid must flow along the straight fluid path and through said one of the frame plate and the pressure plate via the through connection to reach the pressure pulse damping apparatus.

8. The use of the pressure pulse damping apparatus according to claim 7, wherein the elastic element comprises a movable partition, the movable partition being adapted in use to be subjected to a pressure pulse in the first heat exchange fluid.

9. The use of the pressure pulse damping apparatus according to claim 7, wherein the elastic element comprises a chamber which is at least partially filled with a gas, the chamber and the first conduit forming a closed compartment.

10. The use of the pressure pulse damping apparatus according to claim 9, wherein the gas inside the chamber is delimited by the movable partition such that in use the pressure pulse in the first heat exchange fluid is transferred via the movable partition to the gas inside the chamber.

11. The use of the pressure pulse damping apparatus according to claim 8, wherein the elastic element comprises a spring, the spring abutting the movable partition.

12. The use of the pressure pulse damping apparatus according to claim 7, wherein the first side portion of the heat exchanger is formed by a pressure plate or a frame plate.

* * * * *